US010836179B2

(12) United States Patent
Matsuda

(10) Patent No.: US 10,836,179 B2
(45) Date of Patent: Nov. 17, 2020

(54) IMAGE FORMING APPARATUS

(71) Applicant: KYOCERA Document Solutions Inc., Osaka (JP)

(72) Inventor: Masazo Matsuda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/536,623

(22) Filed: Aug. 9, 2019

(65) Prior Publication Data

US 2020/0055318 A1 Feb. 20, 2020

(30) Foreign Application Priority Data

Aug. 17, 2018 (JP) ..... 2018-153627

(51) Int. Cl.
*B41J 2/175* (2006.01)
*G03G 15/00* (2006.01)

(52) U.S. Cl.
CPC ..... *B41J 2/17566* (2013.01); *G03G 15/556* (2013.01); *B41J 2002/17589* (2013.01)

(58) Field of Classification Search
CPC ..... B41J 2/17566; G03G 15/556
See application file for complete search history.

(56) References Cited

U.S. PATENT DOCUMENTS 6,378,971 B1 * 4/2002 Tamura ..... B41J 2/175 347/7
9,757,952 B2 9/2017 Tanaka et al.
2002/0085050 A1 * 7/2002 Aruga ..... B41J 2/17509 347/7
2003/0011668 A1 * 1/2003 Yoshida ..... B41J 2/175 347/86
2004/0135829 A1 * 7/2004 Yoshida ..... B41J 2/175 347/7
2017/0113469 A1 4/2017 Tanaka et al.

FOREIGN PATENT DOCUMENTS

JP 2017080945 A 5/2017

* cited by examiner

*Primary Examiner* — Lamson D Nguyen
(74) *Attorney, Agent, or Firm* — Studebaker & Brackett PC

(57) ABSTRACT

An image forming apparatus includes an image forming section, a main replenishing section, an auxiliary replenishing section, and a controller. The image forming section forms an image on a recording medium using a consumable. The main replenishing section retains the consumable therein. The auxiliary replenishing section is replenished with the consumable from the main replenishing section and replenishes the consumable to the image forming section. The controller controls an image forming speed for forming the image on the recording medium. The controller lowers the image forming speed below a normal speed when a main residual amount corresponding to a remaining amount of the consumable retained in the main replenishing section is no greater than a specified value.

8 Claims, 7 Drawing Sheets

Please replace the yellow ink tank.

M1

FIG. 7

Please replace the yellow ink tank within 20 minutes.

Remaining time: 19:35

M2

FIG. 8

Printing will be stopped after 2 minutes

Please replace the yellow ink tank after printing stops.

M3

FIG. 9

IMAGE FORMING APPARATUS

INCORPORATION BY REFERENCE

The present application claims priority under 35 U.S.C. § 119 to Japanese Patent Application No. 2018-153627, filed on Aug. 17, 2018. The contents of this application are incorporated herein by reference in their entirety.

BACKGROUND

The present disclosure relates to an image forming apparatus.

In a printing device that executes printing using an ink supplied from an ink cartridge, the ink cartridge is removably attached. When the ink held in the ink cartridge is used up in the printing device, it is necessary to remove the used ink cartridge from the printing device to replace it with a new ink cartridge. In a known printing device, the printing can be continuously performed during a replacement operation of the ink cartridge in order to maintain printing productivity.

For example, a given printing device continuously performs printing using an ink held in a buffer tank when an ink held in an ink cartridge is used up.

SUMMARY

An image forming apparatus according to the present disclosure includes an image forming section, a main replenishing section, an auxiliary replenishing section, and a controller. The image forming section forms an image on a recording medium using a consumable. The main replenishing section retains the consumable therein. The auxiliary replenishing section is replenished with the consumable from the main replenishing section and replenishes the consumable to the image forming section. The controller lowers an image forming speed below a normal speed when a main residual amount corresponding to a remaining amount of the consumable retained in the main replenishing section is no greater than a prescribed value.

BRIEF DESCRIPTION OF THE DRAWINGS

FIG. 7 is a diagram illustrating a first screen according to the embodiment of the present disclosure.

FIG. 8 is a diagram illustrating a second screen according to the embodiment of the present disclosure.

FIG. 9 is a diagram illustrating a third screen according to the embodiment of the present disclosure.

DETAILED DESCRIPTION

Figure 1:
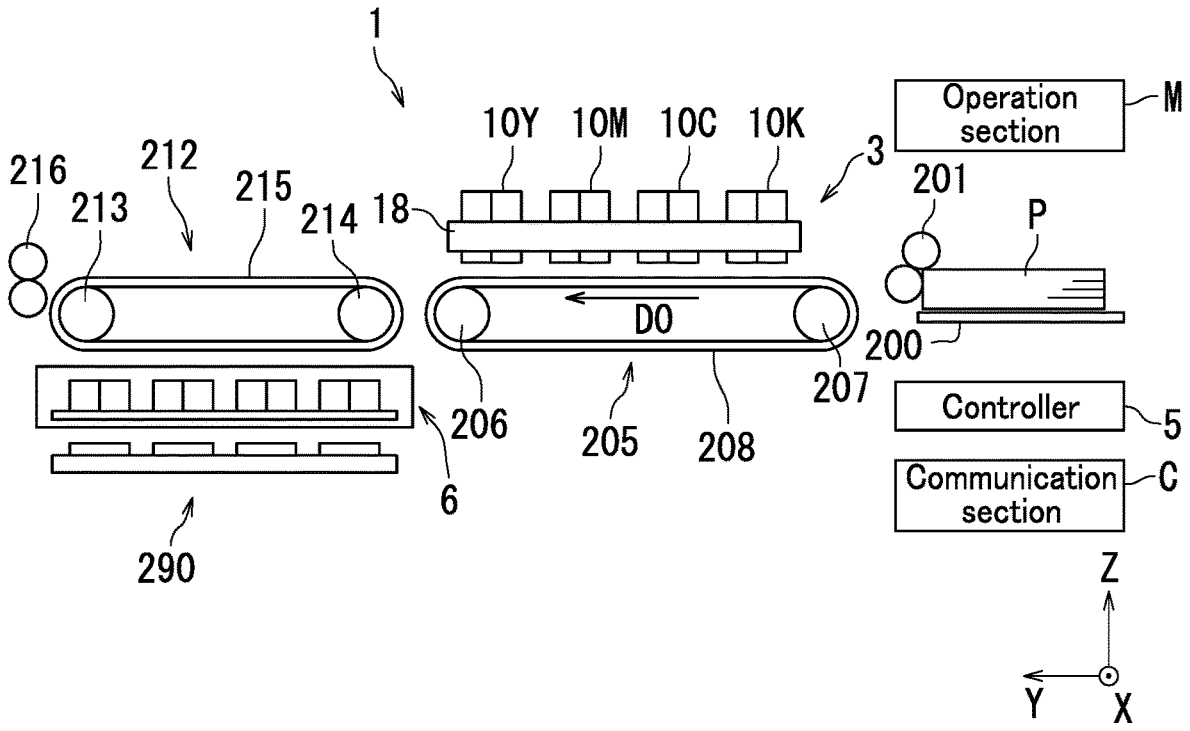
FIG. 1 is a diagram illustrating a configuration of an image forming apparatus according to an embodiment of the present disclosure.

The following describes an embodiment of the present disclosure with reference to the accompanying drawings (FIGS. 1 to 9). It should be noted that the same reference signs are used to refer to the same or corresponding elements in the drawings to avoid redundant description. In the present embodiment, an X-axis and a Y-axis illustrated in the drawings are parallel to a horizontal plane, and a Z-axis is parallel to a vertical line. The X-axis, the Y-axis, the Z-axis are at right angles to one another. In the present specification, the terms "upper" and "lower" respectively indicate "upper" and "lower" along a vertical axis unless otherwise stated.

Figure 2:
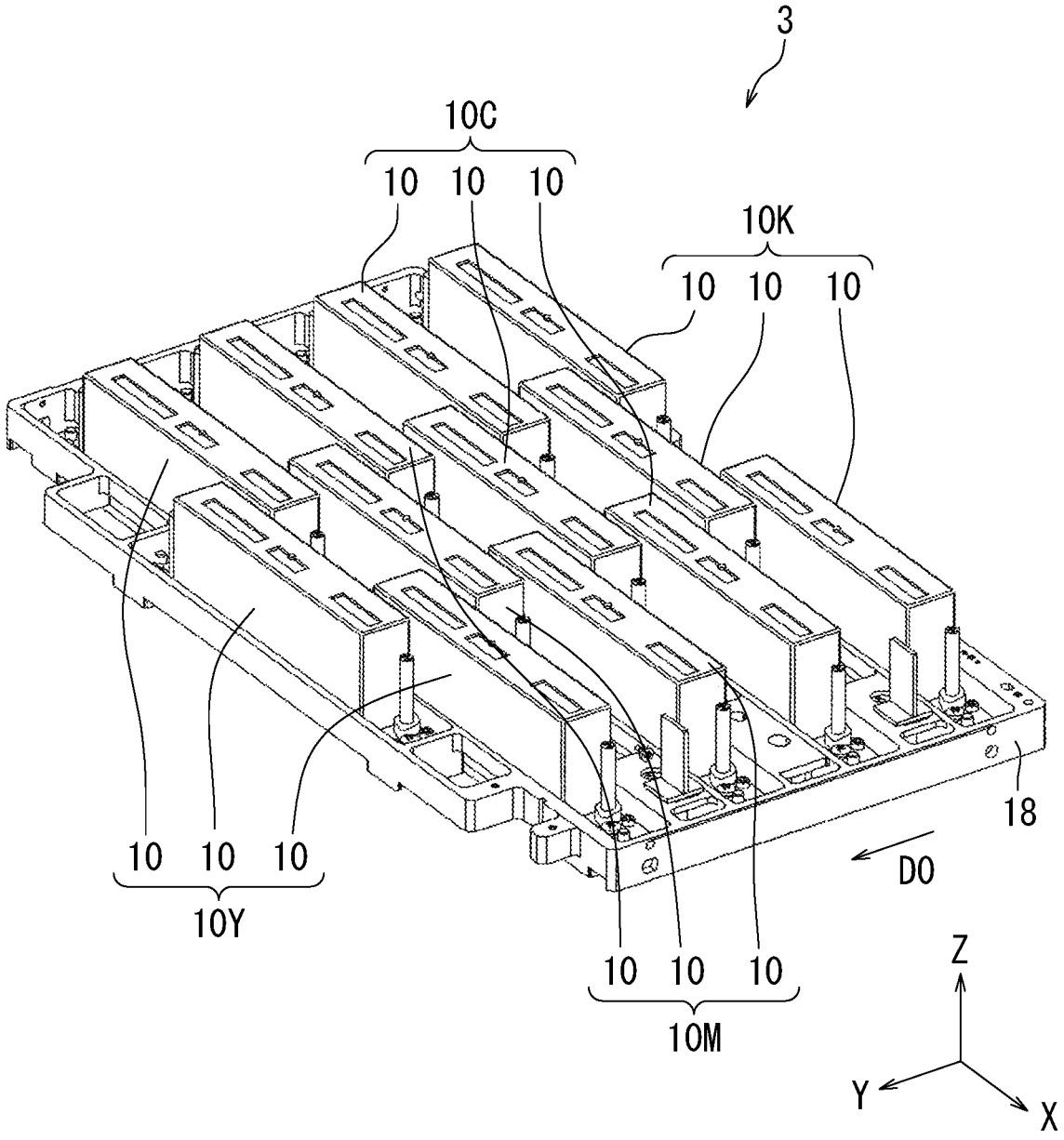
FIG. 2 is a perspective view illustrating a head section of the image forming apparatus according to the embodiment of the present disclosure.

First, referring to FIGS. 1 and 2, an image forming apparatus 1 according to the present embodiment is described. FIG. 1 is a diagram illustrating the configuration of the image forming apparatus 1. The image forming apparatus 1 is, for example, an ink jet recording device. The ink jet recording device is a color printer.

The image forming apparatus 1 includes a tray 200, a feed roller pair 201, a first conveyance unit 205, a head section 3, a second conveyance unit 212, a discharge roller pair 216, a controller 5, an absorbing device 6, a cap unit 290, an operation section M, and a communication section C. The feed roller pair 201, the first conveyance unit 205, the second conveyance unit 212, and the discharge roller pair 216 together constitute an example of a conveying section.

The tray 200 holds recording media P therein. The tray 200 is provided on an upstream side (on the negative side of the Y-axis in FIG. 1) from the first conveyance unit 205 along a conveyance direction D0 of the recording media P. The feed roller pair 201 is provided at an end on a downstream side (on the positive side of the Y-axis in FIG. 1) of the tray 200 along the conveyance direction D0. The feed roller pair 201 supplies the recording media P held in the tray 200 one by one to the first conveyance unit 205.

Each recording medium P is a medium on which an image is formed by the head section 3. The recording medium P includes, for example, a sheet of plain paper, copy paper, recycled paper, thin paper, thick paper, or glossy paper, and a synthetic resin sheet such as an overhead projector (OHP) sheet.

The first conveyance unit 205 conveys the recording medium P in the conveyance direction D0. Specifically, the first conveyance unit 205 includes a first drive roller 206, a first driven roller 207, and a first conveyance belt 208. The first conveyance belt 208 is wound between the first drive roller 206 and the first driven roller 207. The first drive roller 206 is driven to rotate in a counterclockwise direction by an unillustrated motor. Since the first drive roller 206 is thus driven to rotate in the counterclockwise direction, the first conveyance belt 208 is rotated in the counterclockwise direction. Since the first conveyance belt 208 is thus rotated in the counterclockwise direction, the recording medium P loaded on the first conveyance belt 208 is conveyed in the conveyance direction D0.

The head section 3 forms an image on the recording medium P using an ink. Specifically, the head section 3 is disposed to oppose the first conveyance belt 208. The head section 3 includes a head housing 18, and line heads 10Y, 10M, 10C, and 10K. The head housing 18 holds the line heads 10Y, 10M, 10C, and 10K. The line heads 10Y, 10M, 10C, and 10K respectively eject, toward the recording medium P, a yellow ink, a magenta ink, a cyan ink, and a black ink to form an image on the recording medium P. The line heads 10Y to 10K are disposed along the conveyance direction D0 of the recording medium P. It should be noted that the ink is an example of consumable, and the head section 3 is an example of an image forming section.

The second conveyance unit 212 conveys the recording medium P in the conveyance direction D0. Specifically, the second conveyance unit 212 is disposed on the downstream side in the conveyance direction D0 from the first conveyance unit 205. The second conveyance unit 212 includes a second drive roller 213, a second driven roller 214, and a second conveyance belt 215. The second conveyance belt 215 is wound between the second drive roller 213 and the second driven roller 214. The second drive roller 213 is driven to rotate in the counterclockwise direction by an unillustrated motor. Since the second drive roller 213 is thus driven to rotate in the counterclockwise direction, the second conveyance belt 215 is rotated in the counterclockwise direction. Since the second conveyance belt 215 is thus rotated in the counterclockwise direction, the recording medium P loaded on the second conveyance belt 215 is conveyed in the conveyance direction D0.

The recording medium P having an image formed thereon by the head section 3 is fed to the second conveyance unit 212. While the recording medium P is being conveyed by the second conveyance unit 212, the inks adhered to the surface of the recording medium P are dried.

The discharge roller pair 216 discharges the recording medium P out of the image forming apparatus 1. The discharge roller pair 216 is disposed on the downstream side in the conveyance direction D0 from the second conveyance unit 212.

The controller 5 controls operation of each section included in the image forming apparatus 1. The controller 5 includes a processor and storage. The processor includes, for example, a central processing unit (CPU). The storage includes memory such as semiconductor memory. The storage may further include a hard disk drive (HDD). The storage stores a control program. The processor controls an operation of the image forming apparatus 1 by executing the control program.

The absorbing device 6 is disposed below the second conveyance unit 212 at the time of image formation. The controller 5 directs the absorbing device 6 to move to below the head section 3 at the time of maintenance. The absorbing device 6 removes the inks adhered to ejection surfaces of the line heads 10Y to 10K.

The cap unit 290 is disposed below the second conveyance unit 212 at the time of the image formation. The controller 5 directs the cap unit 290 to move to below the head section 3 at the time of non-image formation (for example, during standby). The cap unit 290 is attached to the ejection surfaces of the line heads 10Y to 10K.

The operation section M transmits a user instruction to the controller 5. Besides, the operation section M displays a message from the image forming apparatus 1 for a user. Specifically, the operation section M includes an input section and a display section. The input section transmits a user instruction to the controller 5. The display section displays a message for a user.

In the present embodiment, the operation section M is a touch panel. The operation section M includes a display corresponding to the display section, and a touch sensor corresponding to the input section. The display displays a notification from the image forming apparatus 1 for a user. The display is, for example, a liquid crystal display, or an organic electroluminescent (EL) display. The touch sensor is used for operating the image forming apparatus 1. The touch sensor is provided on the surface of the display. The touch sensor transmits a user instruction to the controller 5.

The communication section C transmits and receives information between the image forming apparatus 1 and an external apparatus through wired or wireless communication.

A method for the wired communication is not especially limited. The method for the wired communication is, for example, a communication method using a cable such as a local area network (LAN) or Universal Serial Bus (USB).

A method for the wireless communication is not especially limited. The method for the wireless communication is, for example, a wireless communication method such as wireless LAN or BLUETOOTH (registered Japanese trademark).

FIG. 2 is a perspective view illustrating the head section 3 of the image forming apparatus 1 of FIG. 1. As illustrated in FIG. 2, each of the line heads 10Y to 10K includes three recording heads 10 disposed in a staggered manner along a direction perpendicular to the conveyance direction D0 (that is, a direction along the X-axis in FIG. 2).

Figure 3:
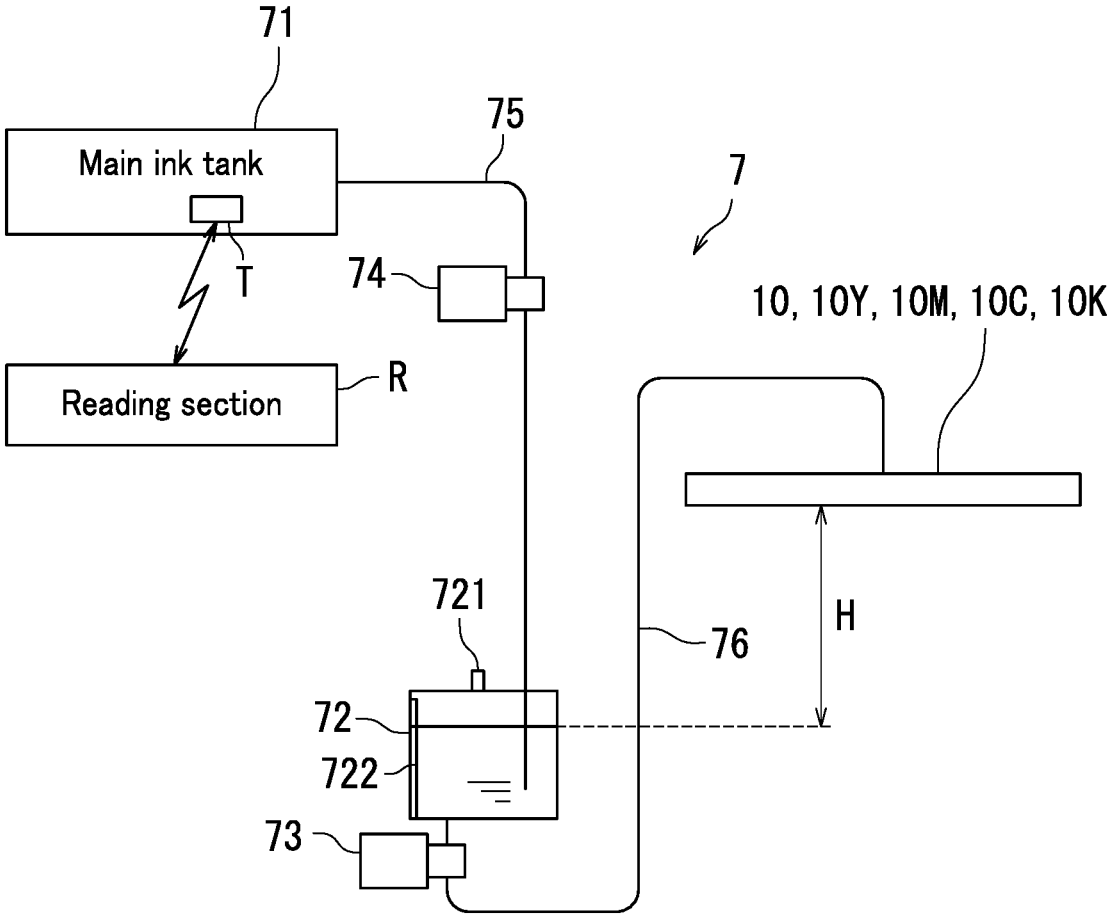
FIG. 3 is a diagram illustrating a configuration of an ink supplying section of the image forming apparatus according to the embodiment of the present disclosure.

Next, referring to FIG. 3, an ink supplying section 7 for supplying the ink to the recording heads 10 (line heads 10Y to 10K) is described. FIG. 3 is a diagram illustrating the configuration of the ink supplying section 7. The image forming apparatus includes an ink supplying section 7 corresponding to the ink of each color. In the present embodiment, the image forming apparatus 1 includes four ink supplying sections 7. The four ink supplying sections 7 have the same configuration excluding the color of the ink retained therein.

Each ink supplying section 7 includes a main ink tank 71, an auxiliary ink tank 72, a first solenoid valve 73, a second solenoid valve 74, a pipe 75, a pipe 76, and a reading section R.

The main ink tank 71 retains the ink therein. The main ink tank 71 is replaceable. A time necessary for replacing the main ink tank 71 is a replacement time.

The main ink tank 71 has an integrated circuit (IC) tag T. Information on the main ink tank 71 is stored in the IC tag T, such as the manufacturer, the manufacture date, a lot number, and the color of the ink.

The reading section R reads the information from the IC tag T. The reading section R detects replacement of the main ink tank 71 based on the presence of the IC tag T or the information stored in the IC tag T. The reading section R detects the replacement of the main ink tank 71, and transmits, to the controller 5, information indicating that the main ink tank 71 has been replaced. The main ink tank 71 is an example of a main replenishing section.

The auxiliary ink tank 72 temporarily retains the ink replenished from the main ink tank 71. The auxiliary ink tank 72 replenishes the ink retained therein to the head section 3. The auxiliary ink tank 72 is an example of an auxiliary replenishing section.

The auxiliary ink tank 72 has a vent 721 on the upper surface thereof. Through the vent 721, air is supplied into the auxiliary ink tank 72 and discharged from the auxiliary ink tank 72. The vent 721 is also provided with an unillustrated filter. Due to the filter, dust is removed from air entering the auxiliary ink tank 72 through the vent 721.

The auxiliary ink tank 72 includes an ink amount sensor 722. The ink amount sensor 722 detects the amount of the ink retained therein. The ink amount sensor 722 is, for example, a liquid level sensor. The liquid level sensor detects the amount of the ink based on the surface of the ink retained in the auxiliary ink tank 72. The ink amount sensor 722 transmits, to the controller 5, information corresponding to the amount of the ink retained in the auxiliary ink tank 72. The amount of the ink is an example of an amount of the consumable.

The upper surface of the ink retained in the auxiliary ink tank 72 is positioned to be lower than the ink ejection surface (the lower surface in FIG. 3) of the recording head 10 by a distance H. The distance H is, for example, at least 50 mm and no greater than 100 mm.

The upper surface of the ink within the auxiliary ink tank 72 is positioned to be lower than the ink ejection surface of the recording head 10. Therefore, an ink channel within the recording head 10 is under negative pressure. As a result, the ink can be prevented from dropping from the recording head 10 at the time of non-image formation.

The pipe 75 connects the main ink tank 71 and the auxiliary ink tank 72 to each other. The ink flows from the main ink tank 71 to the auxiliary ink tank 72 through the pipe 75. The pipe 76 connects the auxiliary ink tank 72 and the recording head 10 to each other. The ink flows from the auxiliary ink tank 72 to the recording head 10 through the pipe 76.

The second solenoid valve 74 is provided in the middle of the pipe 75. The second solenoid valve 74 closes or opens the ink channel from the main ink tank 71 to the auxiliary ink tank 72. The first solenoid valve 73 is provided in the middle of the pipe 76. The first solenoid valve 73 closes or opens the ink channel from the auxiliary ink tank 72 to the recording head 10. The operation of the first solenoid valve 73 and the second solenoid valve 74 is controlled by the controller 5 of FIG. 1.

When the second solenoid valve 74 is opened, a prescribed amount of the ink is replenished from the main ink tank 71 to the auxiliary ink tank 72. As a result, the amount of the ink retained in the main ink tank 71 is reduced. Therefore, based on the number of times of opening the second solenoid valve 74, the controller 5 calculates the reduced amount of the ink retained in the main ink tank 71.

Figure 4:
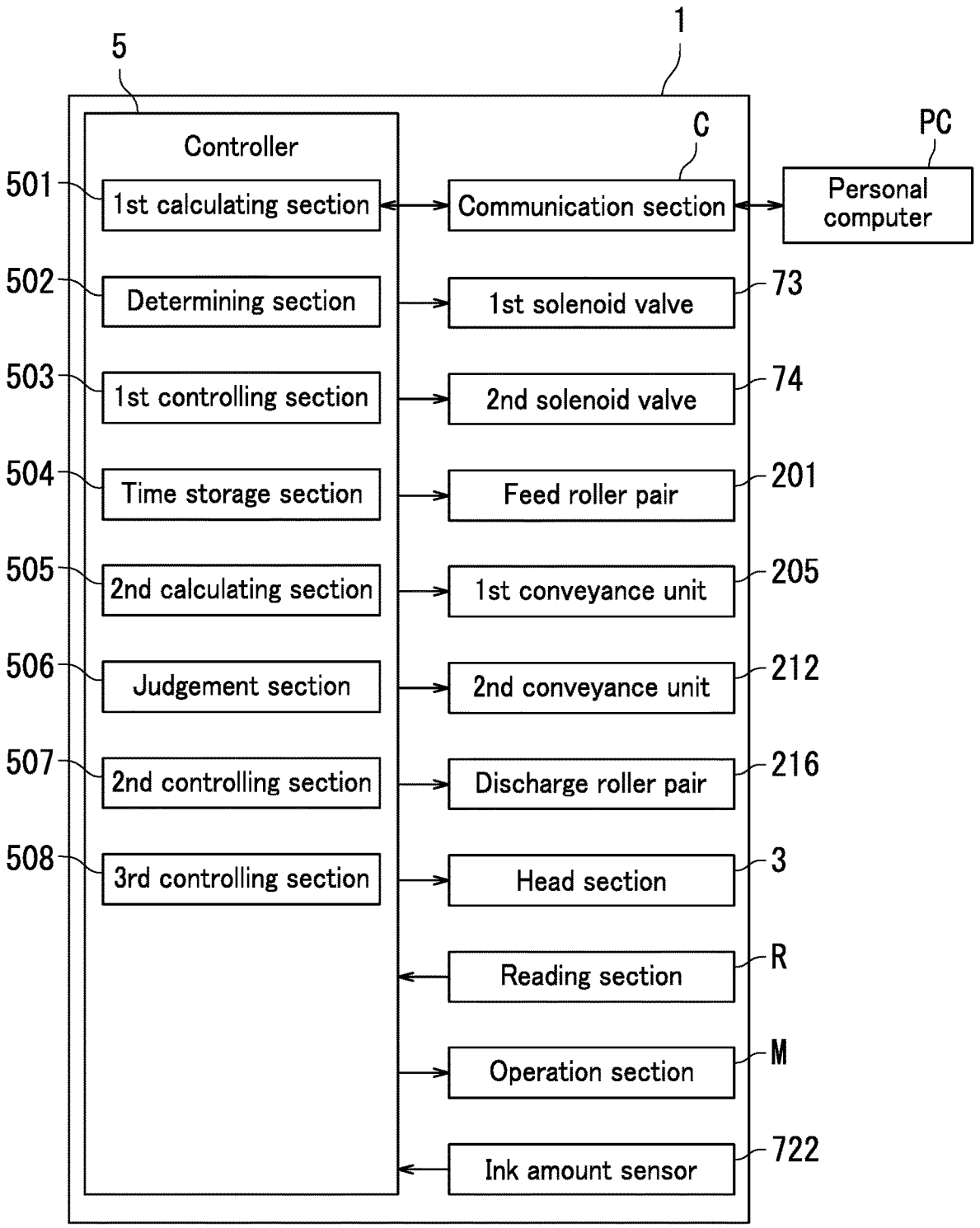
FIG. 4 is a diagram illustrating a configuration of a controller of the image forming apparatus according to the embodiment of the present disclosure.

Next, referring to FIG. 4, the configuration of the controller 5 is described. FIG. 4 is a diagram illustrating the configuration of the controller 5 of the present embodiment. As illustrated in FIG. 4, the controller 5 is connected to a personal computer PC through the communication section C. The controller 5 receives, from the personal computer PC, information such as image data of an image to be formed on the recording medium P.

As illustrated in FIG. 4, the controller 5 is connected to the feed roller pair 201, the first conveyance unit 205, the second conveyance unit 212, and the discharge roller pair 216. The controller 5 is further connected to the head section 3, the reading section R, and the operation section M. The controller 5 is further connected to the first solenoid valve 73, the second solenoid valve 74, and the ink amount sensor 722. The controller 5 actuates the first solenoid valve 73 and the second solenoid valve 74 to control ink supply to the head section 3.

The controller 5 includes a first calculating section 501, a determining section 502, a first controlling section 503, a time storage section 504, a second calculating section 505, a judgement section 506, a second controlling section 507, and a third controlling section 508. Specifically, the processor of the controller 5 functions as the first calculating section 501, the determining section 502, the first controlling section 503, the time storage section 504, the second calculating section 505, the judgement section 506, the second controlling section 507, and the third controlling section 508 by executing the control program stored in the storage.

The first calculating section 501 receives image data from the personal computer PC. The first calculating section 501 calculates, based on the image data, a printing amount corresponding to the amount of the ink necessary for the image formation. When the image data is color image data, the first calculating section 501 calculates printing amounts of the inks of the respective colors.

The determining section 502 determines an image forming speed based on the printing amount calculated by the first calculating section 501, the amount of the ink remaining in the main ink tank 71, and the amount of the ink remaining in the auxiliary ink tank 72. More specifically, the determining section 502 compares, with a specified value, a main residual amount corresponding to the amount of the ink remaining in the main ink tank 71. The specified value is, for example, a value of substantially zero. The determining section 502 also compares, with the printing amount, an auxiliary residual amount corresponding to the amount of the ink remaining in the auxiliary ink tank 72. Based on a comparison result between the main residual amount and the specified value and a comparison result between the auxiliary residual amount and the printing amount, the determining section 502 determines the image forming speed so that an image forming operation can be continued until the replacement time has elapsed. The image forming speed is defined, for example, by the number of recording media P on which images can be formed within a unit of time. Assuming that the image forming speed employed when the main residual amount is larger than the specified value is a normal speed (a prescribed speed), the normal speed is 30 sheets/minute, for example.

The first controlling section 503 controls the image forming speed based on determination made by the determining section 502. Specifically, the first controlling section 503 controls the feed roller pair 201, the first conveyance unit 205, the second conveyance unit 212, and the discharge roller pair 216.

The time storage section 504 stores the replacement time of the main ink tank 71. The replacement time can be set to an arbitrary value depending on an operating environment of the image forming apparatus 1. Specifically, when it takes 5 minutes to walk from the installation place of the image forming apparatus 1 to a storage place of main ink tanks 71, the replacement time is set to at least 10 minutes in the time storage section 504. The replacement time can be freely set by either or both of a serviceman and a user in accordance with the operating environment of the image forming apparatus 1. A user causes the time storage section 504 to store the replacement time through, for example, the personal computer PC. As a result, the replacement time is set.

The second calculating section 505 calculates a continuation speed based on the replacement time and the printing amount. The continuation speed corresponds to an image forming speed to be employed for continuing the image forming operation by the head section 3 until the replacement time has elapsed. For example, when the replacement time is 20 minutes and the number of sheets on which images are to be formed is 40, the continuation speed is 2 sheets/minute.

The judgement section 506 judges, based on the information received from the reading section R, whether or not the main ink tank 71 has been replaced within the replacement time.

The second controlling section 507 controls the first solenoid valve 73, the second solenoid valve 74, and the head section 3 based on the determination made by the determining section 502.

The third controlling section 508 directs the display of the operation section M to display a message from the image forming apparatus 1 for a user. The message includes, for example, a message for prompting replacement of the main ink tank 71, and a message for informing of a remaining time until the replacement time of the main ink tank 71 elapses.

Subsequently, processing for determining the image forming speed by the determining section 502 is more specifically described.

First, processing for determining the image forming speed based on the main residual amount and the specified value is described. The determining section 502 determines whether or not the main residual amount is larger than the specified value. The main residual amount is calculated by the controller 5 based on the number of times of opening the second solenoid valve 74 as described above with reference to FIG. 3.

When the determining section 502 determines that the main residual amount is larger than the specified value, the determining section 502 determines the image forming speed as the normal speed. In the case where the main residual amount is larger than the specified value, even when the image forming speed is set to the normal speed, the head section 3 can continue the image forming operation using the ink retained in the main ink tank 71 until the replacement time has elapsed.

On the contrary, when the determining section 502 determines that the main residual amount is not larger than the specified value, the determining section 502 determines, based on the auxiliary residual amount, whether or not the image forming speed is to be lowered below the normal speed. Specifically, the determining section 502 determines whether or not the auxiliary residual amount is larger than the printing amount.

When the determining section 502 determines that the auxiliary residual amount is larger than the printing amount, the determining section 502 determines the image forming speed as the normal speed. In the case where the auxiliary residual amount is larger than the printing amount, the head section 3 can continue the image forming operation using the ink retained in the auxiliary ink tank 72 until the replacement time has elapsed even when the image forming speed is set to the normal speed.

By contrast, when the determining section 502 determines that the auxiliary residual amount is not larger than the printing amount, the determining section 502 determines that the image forming speed is set to a speed lower than the normal speed. In other words, the determining section 502 lowers the image forming speed below the normal speed.

When the image forming speed is to be lowered below the normal speed, the determining section 502 causes the second calculating section 505 to calculate the continuation speed. Then, the determining section 502 determines whether or not the continuation speed is higher than a minimum image forming speed. The minimum image forming speed corresponds to an image forming speed at which the image quality of an image formed on the recording medium P starts to be lowered. The minimum image forming speed is 0.5 sheets/minute, for example.

When the determining section 502 determines that the continuation speed is higher than the minimum image forming speed, the determining section 502 determines the image forming speed as the continuation speed. When the determining section 502 determines that the continuation speed is not higher than the minimum image forming speed, the determining section 502 determines the image forming speed as the minimum image forming speed.

Incidentally, when the image data is color image data, the determining section 502 selects the color of the ink whose auxiliary residual amount reaches substantially zero earliest, and determines the image forming speed in accordance with the auxiliary residual amount of the ink of the selected color.

Subsequently, processing for determining the image forming speed based on a judgement result obtained by the judgement section 506 is described. When the judgement section 506 judges that the main ink tank 71 has been replaced within the replacement time, the determining section 502 determines the image forming speed as the normal speed. Alternatively, when the judgement section 506 judges that the main ink tank 71 has been replaced after the image forming operation has been suspended, the determining section 502 determines the image forming speed as the normal speed.

By contrast, when the judgement section 506 judges that the main ink tank 71 has not been replaced within the replacement time, the determining section 502 suspends the image forming operation so as not to leave a recording medium P in the conveyance path. Specifically, the determining section 502 directs the first controlling section 503 to suspend the conveyance of the recording medium P by the first conveyance unit 205. The determining section 502 also directs the first controlling section 503 to discharge the recording medium P with an image formed thereon out of the image forming apparatus 1. When the judgement section 506 judges that the main ink tank 71 has not been replaced after the image formation has been suspended, the determining section 502 continues suspension of the image forming operation.

Figure 5:
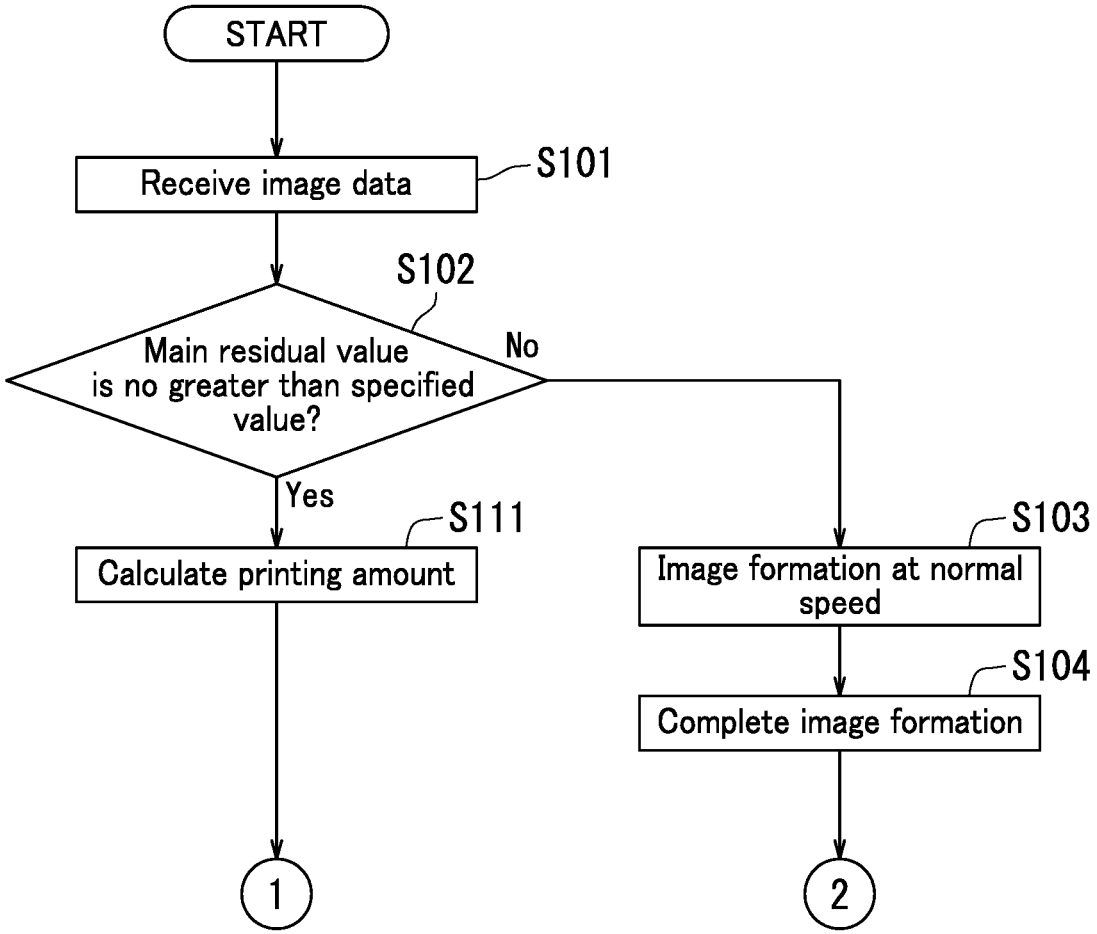
FIG. 5 is a flowchart depicting an operation of the image forming apparatus according to the embodiment of the present disclosure.
Figure 6:
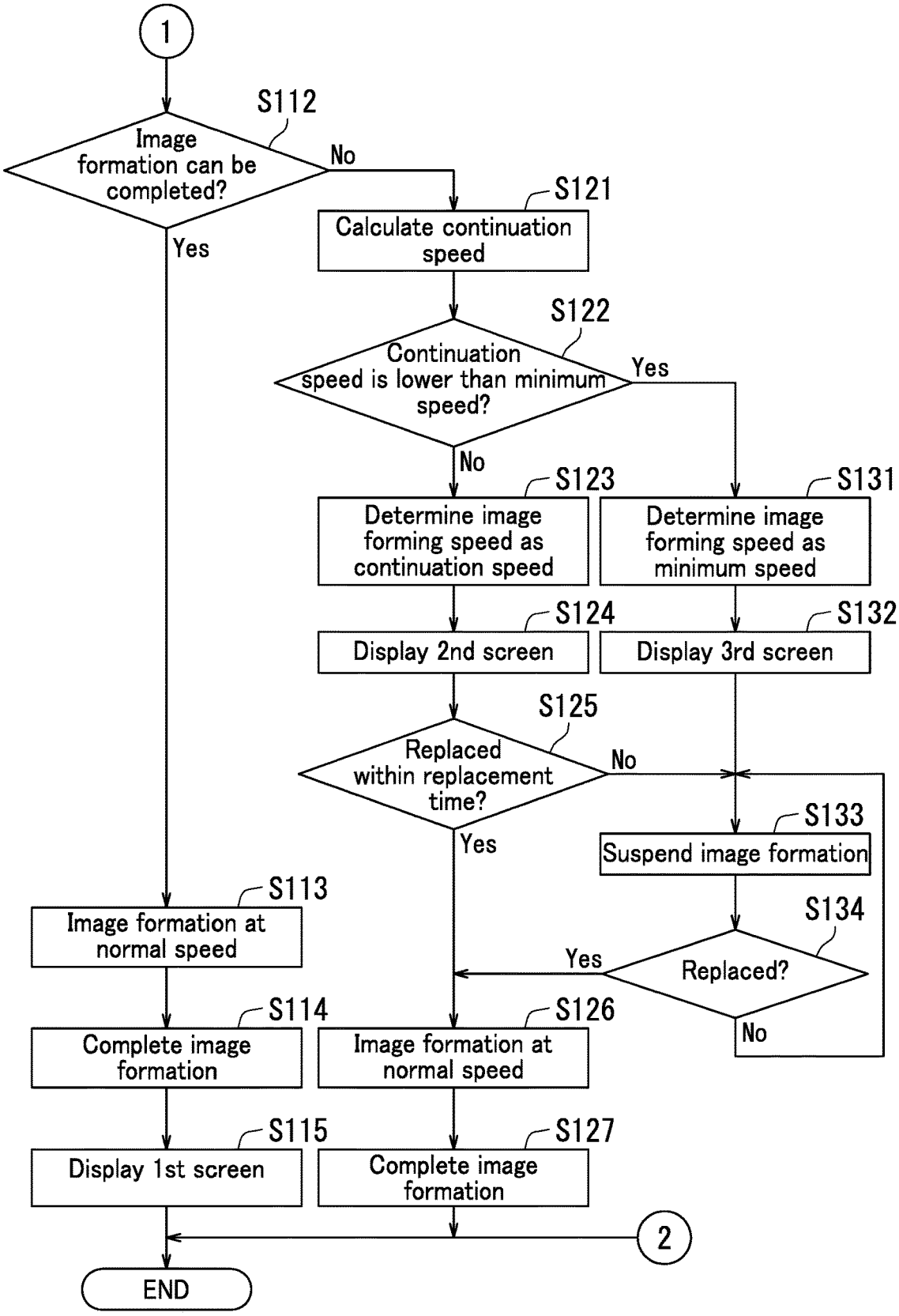
FIG. 6 is a continuation of the flowchart depicting the operation of the image forming apparatus according to the embodiment of the present disclosure.

Next, referring to FIGS. 4 to 6, an operation of the image forming apparatus 1 is described. FIG. 5 is a flowchart depicting the operation of the image forming apparatus 1. FIG. 6 is a continuation of the flowchart of FIG. 5. As illustrated in FIGS. 5 and 6, the image forming apparatus 1 completes a printing job by continuing the image forming operation with the image forming speed changed.

The operation illustrated in FIGS. 5 and 6 is started when a user transmits image data from the personal computer PC to the image forming apparatus 1.

In Step S101, the image forming apparatus 1 receives the image data from the personal computer PC. The operation proceeds to Step S102.

In Step S102, the determining section 502 determines whether or not the main residual amount is no greater than the specified value. When the determining section 502 determines that the main residual amount is no greater than the specified value (Yes in Step S102), the operation proceeds to Step S111. When the determining section 502 determines that the main residual amount is less than the specified value (No in Step S102), the operation proceeds to Step S103.

In Step S103, the determining section 502 determines the image forming speed as the normal speed. As a result, the image forming operation is started at the normal speed. The operation proceeds to Step S104.

In Step S104, the image forming operation is completed. In other words, the printing job is completed.

In Step S111, the first calculating section 501 calculates the printing amount. The operation proceeds to Step S112 of FIG. 6.

In Step S112, the determining section 502 determines whether or not the image formation can be completed with the auxiliary residual amount of the ink. When the determining section 502 determines that the image forming operation can be completed (Yes in Step S112), the operation proceeds to Step S113. When the determining section 502 determines that the image forming operation cannot be completed (No in Step S112), the operation proceeds to Step S121.

In Step S113, the determining section 502 determines the image forming speed as the normal speed. As a result, the image forming operation is started at the normal speed. The operation proceeds to Step S114.

In Step S114, the image forming operation is completed. In other words, the printing job is completed. The operation proceeds to Step S115.

In Step S115, the third controlling section 508 directs the display of the operation section M to display a first screen M1. The first screen M1 displays a message for prompting a user to replace the main ink tank 71 after the image formation has been completed. When the first screen M1 is displayed, the operation illustrated in FIGS. 5 and 6 ends. It should be noted that the first screen M1 is described later with reference to FIG. 7.

In Step S121, the second calculating section 505 calculates the continuation speed based on the replacement time and the printing amount. The operation proceeds to Step S122.

In Step S122, the determining section 502 determines whether or not the continuation speed is lower than the minimum image forming speed. When the determining section 502 determines that the continuation speed is lower (Yes in Step S122), the operation proceeds to Step S131. When the determining section 502 determines that the continuation speed is not lower (No in Step S122), the operation proceeds to Step S123.

In Step S123, the determining section 502 determines the image forming speed as the continuation speed. As a result, the image forming operation is started at the continuation speed. The operation proceeds to Step S124.

In Step S124, the third controlling section 508 directs the display of the operation section M to display a second screen M2. The second screen M2 displays a message for prompting a user to replace the main ink tank 71 within the replacement time. The second screen M2 is described later with reference to FIG. 8. The user sees the second screen M2, and goes to a storage place of main ink tanks 71 for replacement. The operation proceeds to Step S125.

In Step S125, the judgement section 506 judges whether or not the user has been able to replace the main ink tank 71 within the replacement time. When the judgement section 506 judges that the user has been able to replace the main ink tank 71 within the replacement time (Yes in Step S125), the operation proceeds to Step S126. When the judgement section 506 judges that the user has not been able to replace the main ink tank 71 within the replacement time (No in Step S125), the operation proceeds to Step S133.

In Step S131, the determining section 502 determines the image forming speed as the minimum image forming speed. As a result, the image forming operation is started at the minimum image forming speed. The operation proceeds to Step S132.

In Step S132, the third controlling section 508 controls the display of the operation section M to display a third screen M3 on the display of the operation section M. The third screen M3 displays a message for warning that the image forming operation will be suspended. The third screen M3 is described later with reference to FIG. 9. The operation proceeds to Step S133.

In Step S133, the ink retained in the auxiliary ink tank 72 is used up by the head section 3, and the image forming operation is suspended. The operation proceeds to Step S134.

In Step S134, the judgement section 506 judges whether or not the main ink tank 71 has been replaced. When the judgement section 506 judges that the main ink tank 71 has been replaced (Yes in Step S134), the operation proceeds to Step S126. When the judgement section 506 judges that the main ink tank 71 has not been replaced (No in Step S134), the operation proceeds to Step S133, and the procedures of Steps S133 and S134 are repeated until the main ink tank 71 is replaced.

In Step S126, the determining section 502 determines the image forming speed as the normal speed. As a result, the image forming operation is started at the normal speed. The operation proceeds to Step S127.

In Step S127, the image forming operation is completed. In other words, the printing job is completed.

Next, referring to FIGS. 7 to 9, the operation screens displayed in the operation section M of the present embodiment are described. FIG. 7 is a diagram of the first screen M1. The first screen M1 is a screen for prompting replacement of the main ink tank 71 after the image forming operation has been completed. The first screen M1 displays the message for prompting replacement of the main ink tank 71. For example, the first screen M1 displays a message "Please replace the yellow ink tank." as illustrated in FIG. 7.

FIG. 8 is a diagram of the second screen M2. The second screen M2 is a screen for prompting replacement of the main ink tank 71 within the replacement time. The second screen M2 displays a message for prompting replacement of the main ink tank 71 within the replacement time. For example, the second screen M2 displays a message "Please replace the yellow ink tank within 20 minutes." as illustrated in FIG. 8. In the present embodiment, the second screen M2 further displays a remaining time until the elapse of the replacement time. FIG. 8 illustrates "Remaining time: 19:35" as an example.

FIG. 9 is a diagram of the third screen M3. The third screen M3 is a screen for warning that the image forming operation will be suspended. The third screen M3 displays a message for warning that the image forming operation will be suspended. For example, the third screen M3 displays a message "Printing will be stopped after 2 minutes." as illustrated in FIG. 9. In the present embodiment, the third screen M3 further displays a message for prompting replacement of the main ink tank 71. For example, the third screen M3 displays a message "Please replace the yellow ink tank after printing stops." as illustrated in FIG. 9.

The image forming apparatus 1 according to the embodiment of the present disclosure has been described so far with reference to FIGS. 1 to 9. In the image forming apparatus 1 of the present embodiment, even when the amount of the ink retained in the main ink tank 71 is no greater than the specified value, the image forming operation is continued with the image forming speed lowered until the replacement time for the main ink tank 71 has elapsed. Therefore, in the image forming apparatus 1, productivity can be prevented from being lowered due to suspension of the image forming operation for work of replacing the main ink tank 71.

The embodiment of the present disclosure has been described with reference to the drawings. However, the present disclosure is not limited to the above-described embodiment, and can be practiced in a variety of forms without departing from the gist thereof (for example, as described in (1) to (3) below). In the drawings, the respective elements are mainly schematically illustrated for easy understanding, and the thickness, the length, the number, and the like of each element illustrated in the drawings may differ in practice for the sake of convenience for preparing the drawings. Besides, the shape, the dimension, and the like of each element described in the aforementioned embodiment are not restrictive but illustrative, and can be variously modified without substantially departing from the configuration of the present disclosure.

(1) In the embodiment of the present disclosure, as described with reference to FIGS. 1 to 9, the image forming apparatus 1 is a color printer, which does not limit the present disclosure. The image forming apparatus 1 may be, for example, a monochrome printer. Alternatively, the image forming apparatus 1 may be a color multifunction peripheral or a monochrome multifunction peripheral.

(2) In the embodiment of the present disclosure, as described with reference to FIGS. 1 to 9, the image forming apparatus 1 is a printer employing an ink jet recording method, which does not limit the present disclosure. The image forming apparatus 1 may be, for example, a printer employing an electrophotographic method. When the image forming apparatus 1 is a printer employing the electrophotographic method, the consumable corresponds to a toner.

(3) In the embodiment of the present disclosure, as described with reference to FIGS. 1 to 9, the image data is received from the personal computer PC, which does not limit the present disclosure. When the image forming apparatus 1 includes, for example, an image reading section, image data read by the image reading section may be used.

What is claimed is:

1. An image forming apparatus comprising:

an image forming section configured to form an image on a recording medium using a consumable;

a main replenishing section configured to retain the consumable therein;

an auxiliary replenishing section configured to be replenished with the consumable from the main replenishing section and to replenish the consumable to the image forming section; and a controller configured to control an image forming speed for forming the image on the recording medium, wherein the controller lowers the image forming speed below a normal speed when a main residual amount corresponding to a remaining amount of the consumable retained in the main replenishing section is no greater than a specified value.

2. The image forming apparatus according to claim 1, wherein the main replenishing section is replaceable, and when the main residual amount is no greater than the specific value, the controller lowers the image forming speed below the normal speed to cause the image forming section to continue an image forming operation using the consumable retained in the auxiliary replenishing section until a replacement time corresponding to a time necessary for replacing the main replenishing section has elapsed.

3. The image forming apparatus according to claim 2, wherein the controller includes:

a first calculating section configured to calculate, based on image data corresponding to the image, a printing amount corresponding to an amount of the consumable necessary for forming the image;

a determining section configured to compare an auxiliary residual amount corresponding to a remaining amount of the consumable retained in the auxiliary replenishing section with the printing amount when the main residual amount is no greater than the specified value, and to determine to lower the image forming speed below the normal speed to cause the image forming section to continue the image forming operation until the replacement time has elapsed when the auxiliary residual amount is smaller than the printing amount; and a first controlling section configured to lower the image forming speed below the normal speed based on determination made by the determining section.

4. The image forming apparatus according to claim 3, wherein the controller further includes a second calculating section configured to calculate a continuation speed based on the replacement time and the printing amount, the continuation speed corresponds to an image forming speed at which the image forming section continues the image forming operation until the replacement time has elapsed, and when the auxiliary residual amount is smaller than the printing amount, the determining section determines the image forming speed as the continuation speed.

5. The image forming apparatus according to claim 4, wherein the determining section determines the image forming speed as a minimum image forming speed when the image forming speed is lower than the minimum image forming speed, and the minimum image forming speed corresponds to an image forming speed at which quality of the image starts to be lowered.

6. The image forming apparatus according to claim 2, wherein the controller further includes a judgement section configured to judge whether or not the main replenishing section has been replaced within the replacement time, and when the judgement section judges that the main replenishing section has been replaced within the replacement time, the controller determines the image forming speed as the normal speed.

7. The image forming apparatus according to claim 6, wherein the controller suspends conveyance of the recording medium to the image forming section when the judgement section judges that the main replenishing section has not been replaced within the replacement time.

8. The image forming apparatus according to claim 1, further comprising a display section, wherein the controller causes the display section to display a message for a user.

* * * * *